United States Patent [19]

Wright

[11] Patent Number: 4,604,761

[45] Date of Patent: Aug. 12, 1986

[54] WOMAN'S OUTER GARMENT

[76] Inventor: Joyce Wright, 2155 Harshman Blvd., Springfield, Ohio 45504

[21] Appl. No.: 798,790

[22] Filed: Nov. 18, 1985

[51] Int. Cl.[4] ..... A41D 1/06

[52] U.S. Cl. ..... 2/227

[58] Field of Search ..... 2/227, 234, 237, 236

[56] References Cited

U.S. PATENT DOCUMENTS 2,113,732 4/1938 Koppel ..... 2/234

4,389,733 6/1983 Boykins, Jr. ..... 2/234

*Primary Examiner*—Doris L. Troutman

*Attorney, Agent, or Firm*—Biebel, French & Nauman

[57] ABSTRACT

An outdoor sportswear garment in the form of trousers, for women, permit a woman to urinate without exposing her back. The trousers are formed with leg sections closed about the hip and buttocks and partially closed at the abdomen while defining and forming a front opening which extends generally from the crotch region and terminates at the waistband. A yoke extends between the legs and is permanently attached at the back at the waistband, and is formed with a somewhat enlarged front panel which fully closes the opening, and is attached at peripheral regions by a plurality of Velcro-type fasteners. The yoke is made of three sections of material including complimentary curved side sections and a center panel which are shown together in such a manner that the side sections fully conform to the curvature of the legs along the inseam and together with the front panel provide full protection of the wearer from exposure.

5 Claims, 10 Drawing Figures

10
11
12
13
15
16
18
19
19A
30
32
33
34
38
42

WOMAN'S OUTER GARMENT

BACKGROUND OF THE PRESENT INVENTION

The present invention is directed to a woman's outer garment and more particularly to a garment for use by women who enjoy outdoor sports or other activities such as fishing, camping, hunting, climbing, skiing or hiking, which sports or activities are often performed remote from toilet or other convenience facilities.

Women partaking in such outdoor adventures in mixed company may be caused to suffer anxiety, discomfort and embarrassment when required to urinate under such conditions. Since a person cannot always anticipate whether facilities are available or if they are not, whether a discretely secluded place can be found, she may forego the activity, or otherwise obtain far less enjoyment because of the attendant anxiety or possible embarrassment.

There accordingly exists a need for a woman's outdoor sportswear garment of attactive appearance, which permits the wearer to urinate without exposing her backside. While the prior art includes examples of outdoor apparel, such as jumpsuits or the like, these are not designed primarily with the needs of a woman in mind, and while they may be provided with droppable back panels, they are not provided with an essentially closed back and a droppable or removable front panel.

SUMMARY OF THE INVENTION

The present invention is directed to an outer garment in the form of trousers, Bermuda shorts and the like, in which a yoke member may be partially removed, exposing an open front to the garment. The yoke member may be brought rearwardly through the crotch and held up at the rear. The garment fully covers the posterior view, while providing a front and bottom aperture. The yoke panel is normally held in a closed position by attachment regions along the upper sides of the pant legs and about the waistband, while extending through the crotch and is permanently attached at the rear. Preferably, Velcro fastening strips are used for retaining the yoke panel in a closed position, as well as for retaining the waistband in an adjusted position.

It is accordingly an important object of this invention to provide an outdoor womanswear garment which is attactive in appearance and which will provide a woman with a measure of privacy in permitting her to urinate with her back turned to any persons who might be in the area, without exposing herself to such persons.

It is further an object of this invention to provide a pair of trousers, slacks, Bermuda shorts or the like, which are provided with a yoke generally attached at the rear, brought through the crotch, and up the front panel of the garment, normally closing an opening formed in the front of the garment.

A still further object of the invention is to provide an outer garment for women, in the form of trousers, slacks, Bermuda shorts or the like, in which the front of the garment is formed with an opening extending to the crotch, and is further provided with a yoke or panel generally attached at the rear and brought up through the legs and fully covering the front opening and extending to the waistband.

These and other objects and advantages of the invention will be apparent from the following description, the accompanying drawings, and the appended claims.

DESCRIPTION OF PREFERRED EMBODIMENT

Figures 1, 2, 3:
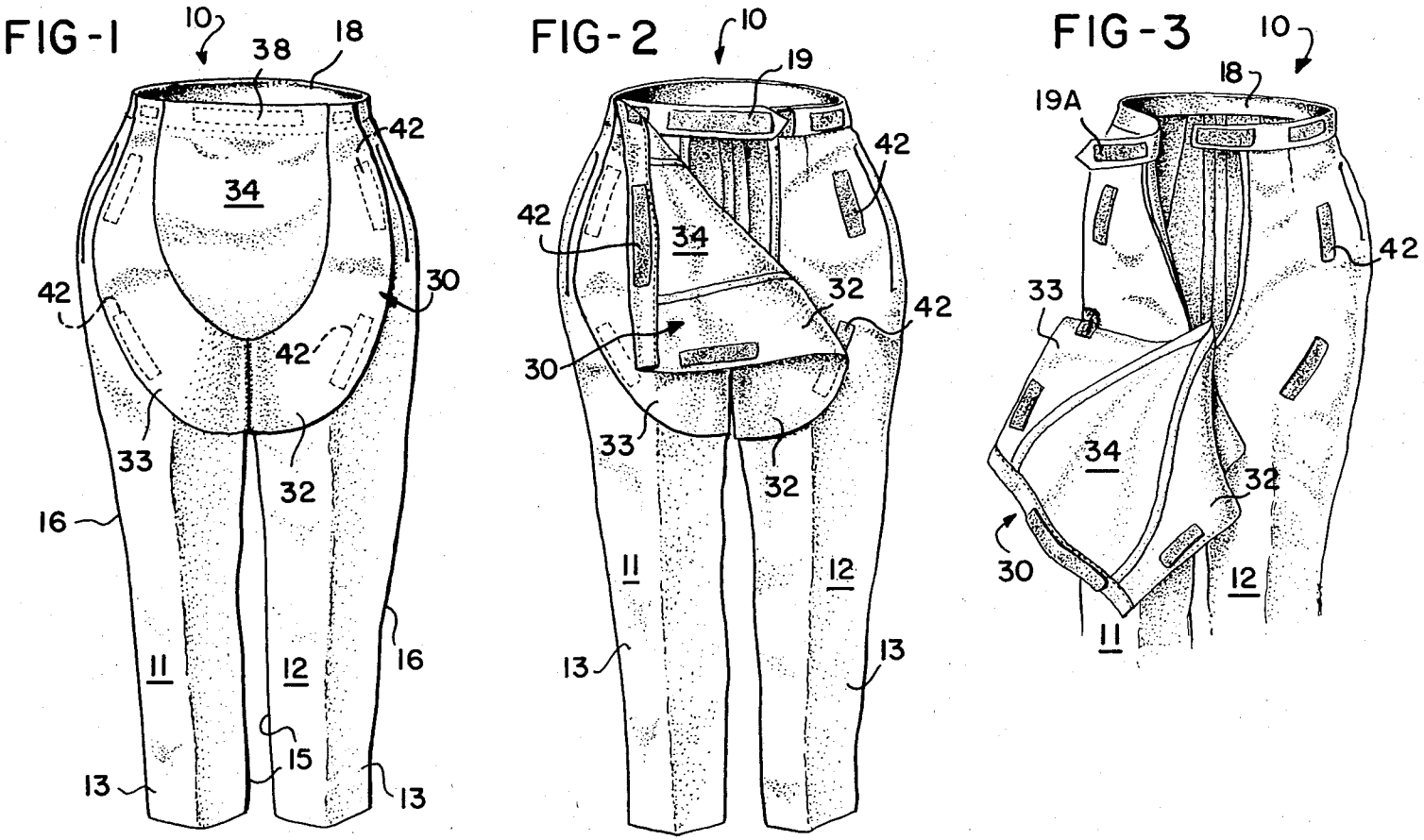
FIG. 1 is a front view of the garment of the invention.
FIG. 2 is a view similar to FIG. 1 with the yoke partially retracted.
FIG. 3 is a view similar to FIG. 1 with the yoke dropped.

Referring to the drawings which illustrate a preferred embodiment of the invention, a woman's outdoor sports garment constructed according to this invention is illustrated generally at 10 in FIG. 1. The garment is shown in the form of a pair of trousers or slacks, although it will be readily understood that the advantages of this invention could be applied to other forms of garments, such as Bermuda shorts, for example.

The garment 10 is formed with conventional legs 11 and 12. These legs are formed, as conventional in the manufacture of trousers, by using left and right front and back panels 13 and 14 (FIG. 8) which are then sewn together along inseams 15 and outer seams 16, and joined about a common waistband 18. The waistband 18 may be provided with a belt-like adjusting tab 19 (FIG. 2) adjusted to overlap a portion of the encircling waistband and provided with an inside Velcro fastening pad **19*a*, shown in FIG. 8**, for the purpose of snugly and comfortably adjusting the waistband of the trousers in use.

Figure 4:
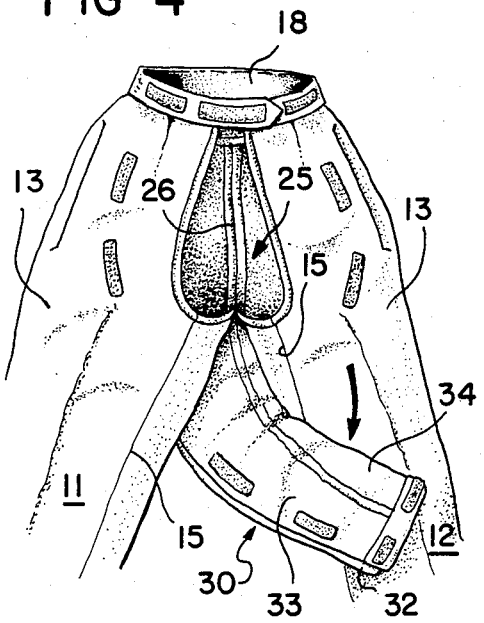
FIG. 4 shows the garment with the yoke being extracted between the legs.
Figure 5:
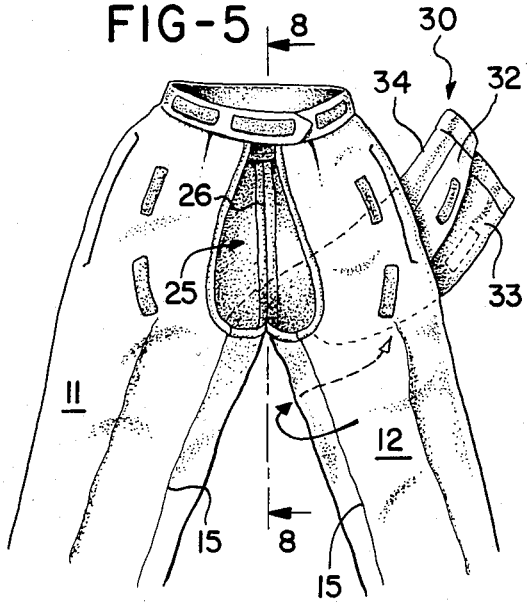
FIG. 5 shows the front view of the garment with the yoke brought up behind the legs.
Figure 6:
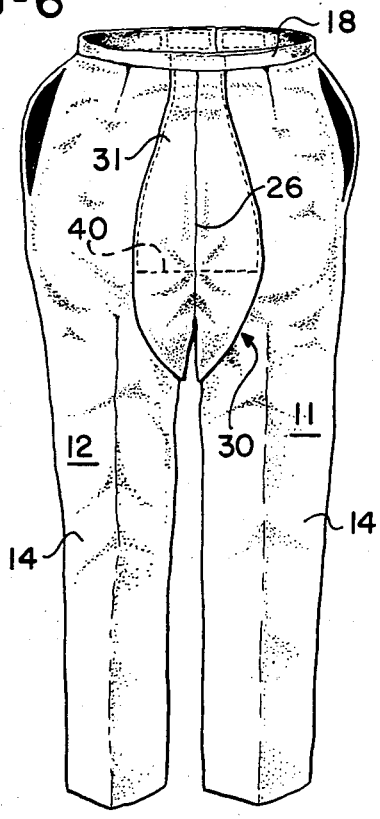
FIG. 6 is a rear view of the garment with the yoke closed, as shown in FIG. 1.

As perhaps best shown in FIGS. 4, 5 and 6, panels 13 and 14 making up the legs 11 and 12 are fully closed about the hip (FIG. 6), but are open at the region of the crotch beginning from a point rearwardly of the inseam 15 and extending upwardly to the waistband 18, defining a frontal and bottom opening 25 (FIG. 4). The bottom of the frontal opening 25 terminates at a conventional crotch seam 26 which may be double-stiched for strength. The frontal and bottom opening 25 is formed by cutting away corresponding portions of the left and right front panels 13 and smaller complementary portions of the left and right rear panels 14, at the inseam region and forward of the crotch seam 26, to form the opening 25. The margins of the opening 25 may be double stitched or suitably bound or finished in a conventional manner. The opening 25 which is thus formed, and may be widened by spreading apart the legs 11 and 12, thus extends from a point somewhat rearwardly of the vertical line defined by the inseam 15 and forwardly up to the waistband region 18.

Figure 7:
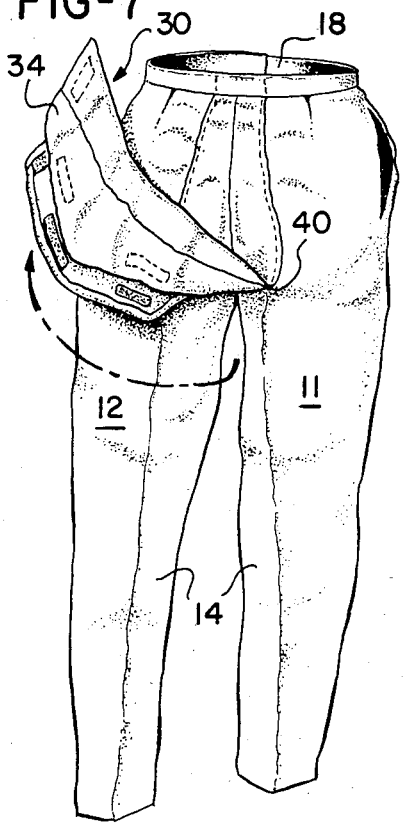
FIG. 7 is the rear view of FIG. 6 with the yoke brought up behind the wearer.
Figure 8:
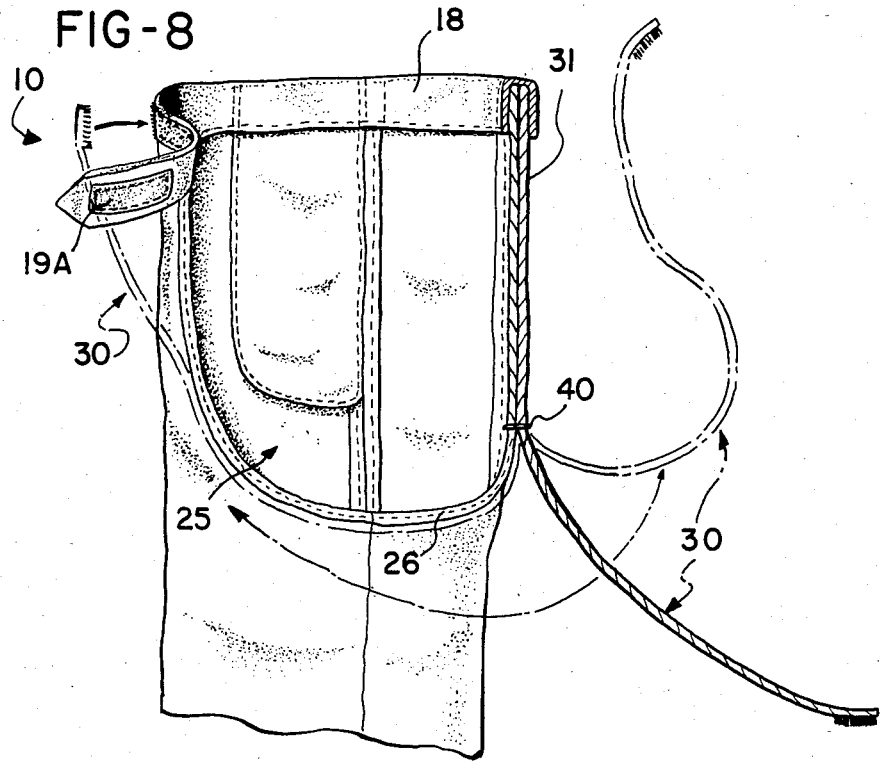
FIG. 8 is an enlarged vertical fragmentary section through the garment looking generally along the lines 8—8 of FIG. 5.
Figure 9:
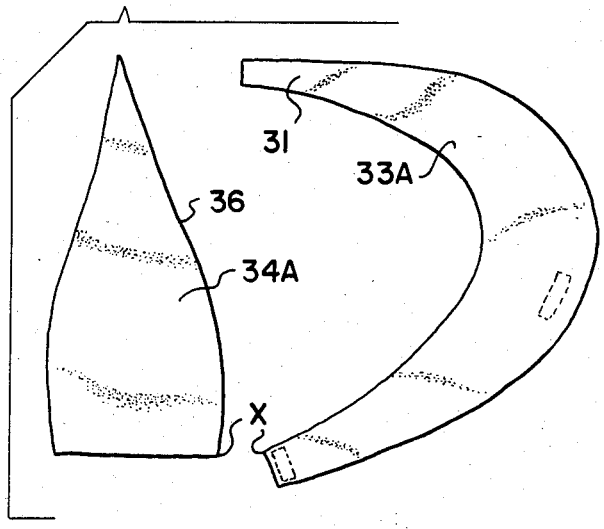
FIG. 9 illustrates a pattern for the yoke.
Figure 10:
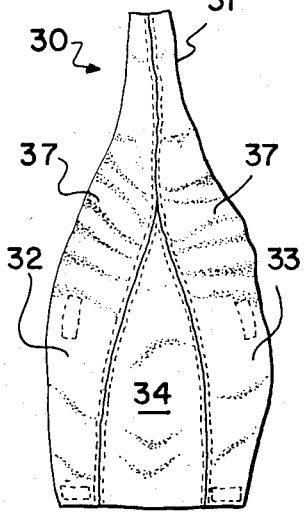
FIG. 10 is a plan view of the yoke in accordance with the pattern of FIG. 9.

The opening 25 is normally closed by an enlarged panel-like yoke 30, shown in assembled form in FIG. 10. The yoke 30 may be made from the pieces of the pattern a illustrated in FIG. 9 and includes a pair of identical curved side sections 32 and 33, and a front relatively flat intermediate panel section 34. The side sections 32 and 33 are made from the pattern 33*a* (FIG. 9) in left and right-hand sections, while the center section 34 is made from the pattern section 34*a* (FIG. 9). In assembly, the side 32 and 33 are seamed and joined together with the center panel 34 along the side surfaces 36 of the panel 34 beginning at the top of the side sections 32 and 33 and beginning at the region marked by an X in FIG. 9 so that the assembled completed yoke 30 takes generally the form illustrated in FIG. 10 in which the opposite side sections have gathered material at 37 between the tail piece 31 and the top. In this manner, the yoke 30 is caused to follow the contour of the inside surfaces of the respective legs when the panel is brought up into the closed position as illustrated in FIG. 1. Accordingly, the side sections 32 and 33 of the yoke are curved sections which, when attached to the center panel 34, conform to the contour of the legs, and the front panel section along with the adjacent portions of the side sections conform to the front flat surface of the abdomen. The tail piece portion 31 is positioned over the crotch seam 26 and extends in the rear up to the waistband 18, as best shown in FIGS. 6 and 7 and also as shown in section in FIG. 8. The yoke 30 is thus permanently attached at the rear of the garment with a reinforcing seam which extends downwardly to a phantom hinge line 40, at the top of the crotch seam 26, at the rear of the garment. A major portion of the yoke 30 including a major portion of the side portions 32 and 33, and the entire center panel portion 34, are not permanently attached, but rather may swing downwardly and rearwardly about the hinge line 40, as shown in FIGS. 7 and 8.

From the hinge or attachment point 40, the yoke 30 extends between the legs with a front portion up over the front opening 25 to the waistband 28, completely closing the opening. In the closed position, as best shown in FIG. 1 and as shown partially open in FIG. 2, the yoke 30 is provided with a plurality of Velcro strips 42 about the margin and across the waistband region so that the yoke remains comfortably in place across the abdomen and secured generally without gaps or openings. The yoke, at the exposed front and along the sides of the legs, is of course substantially larger than the opening 25 to provide for full protection to the wearer.

In the closed position, it will be seen that the side sections 32 and 33 closely conform to the contour of the legs in the region of the crotch, and form a sportswear garment of pleasing appearance.

The manner of use of the garment should be largely self-evident from the foregoing description. When the yoke 30 is released, in the manner shown in FIG. 2, the major portion of the yoke will drop down between the legs as shown in FIG. 4, and then can be held up out of the way in the rear by hand in the position shown in FIGS. 5 and 7. Since the front opening 25 extends through a major length of the crotch portion, when exposed as shown in FIG. 5 for example, the female wearer remains fully covered and clothed in the rear as shown in FIG. 7. If desired, a minipad may be removably attached to the yoke, at the central portion thereof. Furthermore, the garment may be worn with or without special underwear. A woman may stoop, squat or sit at the edge of something, such as a log, when urinating, and be fully covered and clothed from the rear.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An outdoor sportswear trouser-like garment for women comprising:

left and right leg sections closed about the hips and buttocks having a waistband encircling the waist and being partially closed at the abdomen defining and forming a front opening which extends generally from the crotch region toward the waistband, a yoke having a rear portion fastened at the back of the garment adjacent the waistband and extending through the crotch upwardly and having a front panel formed in fully closed relation to said opening and normally covering said opening, means attaching said front panel to said leg sections adjacent said waistband.

2. The sportswear garment of claim 1 in which said yoke is formed with a pair of side sections which, in the crotch region, conform smoothly to the curvature of the respective legs, and said front panel is formed with a centerpiece which conforms smoothly to the abdomen region.

3. The garment of claim 2 in which said yoke side sections are curved pieces of material and joined with said front panel along relatively straight lines so that said side sections conform to the inseam generally about the legs to provide full protection of the wearer from exposure through said front opening.

4. The garment of claim 2 further comprising a plurality of Velcro attachments extending along the outer margins of said side sections joining said sections to said leg sections at the front of the garment for holding said front panel of said yoke flat against the abdomen.

5. An outdoor sportswear trouser for women comprising:

left and right leg sections closed about the hips and buttocks and closed at an encircling waistband, said sections being partially closed at the abdomen defining and forming a front opening which extends generally from the crotch region terminating at said waistband, a yoke having a rear portion fastened to the trousers at the back thereof at said waistband and extending through the crotch and upwardly terminating at a front portion in closing relation to said opening and normally covering said opening, and means attaching said front portion of said yoke to the trousers adjacent said waistband.

* * * * *